United States Patent [19]

Rhian et al.

[11] Patent Number: 5,016,370

[45] Date of Patent: May 21, 1991

[54] ONE PIECE ADHESIVE FOLDER TAB EXTENSION

[75] Inventors: Walter G. Rhian, Hattiesburg, Miss.; Kent E. Niequist, West Chicago, Ill.

[73] Assignee: Murray Envelope Corporation, Hattiesburg, Miss.

[21] Appl. No.: 519,470

[22] Filed: May 7, 1990

[51] Int. Cl.[5] ..... B42F 21/06

[52] U.S. Cl. ..... 40/359; 40/461; 283/36; 283/81

[58] Field of Search ..... 40/359, 360, 299, 641; 283/36, 81

[56] References Cited

U.S. PATENT DOCUMENTS

| | | | |
|---|---|---|---|
| 1,391,182 | 9/1921 | Gale | 40/641 X |
| 2,207,657 | 7/1940 | Chamberlin | 40/360 |
| 2,815,595 | 3/1956 | Davis . | |
| 4,580,815 | 4/1986 | Barber . | |

OTHER PUBLICATIONS

Smead Manufacturing Company, Catalog 89, p. 92.

*Primary Examiner*—Kenneth J. Dorner
*Assistant Examiner*—J. Bonifanti
*Attorney, Agent, or Firm*—Sixbey, Friedman, Leedom & Ferguson

[57] ABSTRACT

A one piece adhesive extension tab for forming a cantilevered extension along one edge of a folder. The tab includes an elongated planar member defined by first and second longitudinal edges, first and second lateral edges, and first and second surfaces extending between the edges. A fold line runs parallel to the first and second longitudinal edges to divide the elongated planar member into first and second longitudinal sides. The planar member is foldable along the fold line to form the tab. A visual alignment mechanism is formed on the planar member for facilitating straight and uniform positioning of the tab on the edge of the folder by aligning with the edge of the folder. The visual alignment mechanism includes an opening for viewing the edge of the folder, and a longitudinal line extending from the opening and parallel to the fold line for aligning with the folder edge viewed through the opening. A third longitudinal edge of the planar sheet also aligns with the folder edge. A fourth longitudinal edge formed on the planar member defines a portion of a cutout which receives the folder side walls of expandable pocket folders.

14 Claims, 3 Drawing Sheets

ONE PIECE ADHESIVE FOLDER TAB EXTENSION

BACKGROUND OF THE INVENTION

1. Technical Field

The present invention relates to tabs for attachment to folders to permit the attachment of labels for filing purposes. More particularly, the present invention relates to one piece adhesive tabs for forming an extension along one edge of either standard or expandable pocket files.

2. Description of Related Art

Tabbed folders, dividers, and similar items are a commonly used office supply. The tabs on these items are used to attach or write identifying information regarding the item as well as to facilitate the physical retrieval of the item from a storage or resting place. However, folders, dividers, etc. are frequently purchased without tabs and it later becomes desirable, for example, to identify the materials in the folder. While one solution is to replace the folder with one having tabs, this is not always practical, especially where large quantities of folders need to be replaced. An alternate and relatively inexpensive solution is to affix a separate tab to the folder for receipt of identifying information. Thus, it is well known and quite common in office settings to add tabs to the edge of standard files, expandable pocket files, folders, dividers, and other planar sheet type devices to provide labeling data such as a reference legend or alphabetical/numerical codes, color coded arrangements, to add machine readable data, or simply to provide an extension of the folder edge. There are many different types of commercially available add-on tabs that are relatively simple in design, that attach to an edge of a folder to project outwardly, and permit the addition of labeling data to the folder. Two such tab configurations are disclosed in U.S. Pat. No. 3,747,242 to Heimann and U.S. Pat. No. 4,201,403 to Turner. However, neither of these tab systems extend along substantially the entire edge of a folder, and because they are flimsy, during ordinary use it is not unusual for these tabs to be readily torn from the folder. Furthermore, these tabs are not disclosed as being usable with expandable pocket-type folders, and they do not appear to be readily adaptable for this use. In Heimann, the tab extends a substantially large distance across the member on which it is mounted so that it could not be mounted on the side of an expandable pocket-type folder.

Metal tabs, such as those disclosed in U.S. Pat. No. 1,373,063 to Feldmann are attached to index cards and the like by driving spurs on the base of the tab into the card and overlapping a tongue portion over the top of the card. However, tabs such as this are expensive, are relatively complex to apply, and are not as readily adaptable to receipt of identifying information as paper tabs. Also, these tabs do not extend along substantially the entire length of the card or folder, and would be difficult to apply in the vicinity of the accordion folds of an expandable pocket-type folder.

Furthermore, none of the various add-on tabs described above provide any mechanism by which the tab may be quickly and properly aligned along the folder edge. That is, these tabs must be aligned by trial and error placement and replacement, and unless sufficient time is taken to apply the tabs, the tabs can be misapplied. Usually, when this occurs, the tab must be removed, discarded, and replaced. This further increases the time and the cost of adding labeling data to a folder.

U.S. Pat. No. 2,815,595 to Davis discloses an adhesive index tab which is mountable on folders or similar items and includes a mechanical system for positioning the tab on the file wall. A series of perforations have flaps which extend in a direction perpendicular to the planar surface of the tab and are formed by stamping a T-cut and inwardly bending the corners of the cut. The tab is attached to the folder using adhesive, and the flaps do not assist in attachment. However, this index tab configuration relies on a nonplanar three dimensional form which requires additional machining steps. Additionally, this tab requires extra space for storage and shipping and, if the flaps should break or become flattened, trial and error would be required to align the tab on a folder. Furthermore, this tab is not disclosed as extending along the entire length of the file, or as usable with pocket-type folders.

These and many other add-on tab devices provide tabs that are relatively short, extending along only a small percentage of the folder wall. Where longer labeling surfaces are desired or where substantially the entire folder wall edge requires a tab extension, it is necessary to apply a plurality of these extension tabs. This is very time consuming and expensive because a plurality of tabs must be applied to each folder. Also, the relative movement between individual tabs can result in the tabs being caught on external items and being damaged or torn from the folder edge. The individuality of the tabs also makes it difficult to apply identifying information thereto.

A more recent patent to Barber, U.S. Pat. No. 4,580,815, discloses a multiple component, composite strip add-on tab for application to the edge of a file folder. The add-on tab includes two separate primary members, a tab extension member and a carrier. The tab extension member is a rectangular elongated member that abuts the edge of the file while the carrier, with adhesive on both of its inner flaps, adheres to both sides of the tab extension member as well as the front and back surfaces of a folder wall. This device is complex and requires two separate elements to form the tab. Moreover, if trial and error is to be avoided in folding the carrier and aligning the tab on the folder, a separate template is used. Although the template properly aligns the tab, it requires a series of steps to guide the tab extension member and the carrier into alignment with the folder. Thus, this system requires a relatively complex mechanical system including a separate alignment device to align a tab extension on a file folder and requires a series of time consuming steps.

Barber does indicate that his add-on tab may be applied to an expandable pocket file. However, because the same construction is used on an expandable pocket file as that described above for a simple file folder, the same disadvantages apply. Furthermore, since the carrier portion of the add-on tab is merely attached to the gusseted side wall of the folder, this impairs the ability of the folder to expand or contract and unnecessarily increases the thickness of an unexpanded folder. This complicates the aligning or applying of the tab, making it necessary to partially sever the carrier adjacent the edge of the gusset.

Thus, although numerous configurations and types of add-on or extension tabs for folders are well known, none of the prior art versions discloses a simple, flat adhesive tab that is applied to the edge of file folders and pocket file folders in a cantilevered manner and that is alignable on the folder edge in a simple manner using only a visual alignment device that is integrated into the tab, itself. Accordingly, there is a need for a simple extension tab that is easy to use, inexpensive to manufacture, store, and ship, and that may be used on open file folders as well as expandable pocket file folders without the various disadvantages of prior art tab systems. Likewise, there is a need for a cantilevered extension tab which uses only a visual alignment system that is integrated into the tab to align the tab on a folder. There is especially a need for an extension tab which is formed of a single sheet of stock material which is applied simply by folding the tab, aligning it with a folder wall, and adhering the tab to the folder wall.

SUMMARY OF THE INVENTION

It is an object of the present invention to provide a simple one piece extension tab for forming a cantilevered extension along one edge of a folder that is easy to use, is inexpensive to manufacture, store, and ship, and that overcomes the disadvantages associated with known prior art tabs.

It is another object of the present invention to provide a one piece adhesive tab for forming a cantilevered extension along one edge of a folder which is usable on open file folders as well as pocket type file folders.

It is still another object of the present invention to provide a one piece adhesive tab for forming a cantilevered extension along one edge of a folder which is alignable on the folder using only a visual alignment device on the adhesive tab.

A further object of the present invention is to provide a one piece adhesive tab for forming a cantilevered extension along substantially the full length of one edge of a folder which is formed of a single sheet of stock material and which is applied to the folder simply by folding the tab, aligning the tab with the folder wall, and adhering the tab to the folder wall.

It is yet another object of the present invention to provide a one piece adhesive tab for forming a cantilevered extension along one edge of a folder which is alignable on the folder using a visual alignment device which includes an opening formed through the tab for sighting the edge of the folder, and a line printed on the tab adjacent the opening for aligning with the folder edge sighted through the opening.

It is another object of the present invention to provide a one piece adhesive tab for forming a cantilevered extension along one edge of a folder, wherein the tab is folded before placement on the folder and the tab has a visual alignment device which includes an opening and wherein adhesive used to affix the tab on the folder is located on portions of the tab such that when the tab is folded, the aligning opening is not located opposite a portion containing adhesive.

Still another object of the present invention is to provide a one piece adhesive tab for forming a cantilevered extension along one edge of a folder which is alignable on the folder using a visual alignment device which includes a longitudinal edge formed on the tab which aligns with one edge of the folder and which extends for a distance from one end edge such that the remaining lengthwise distance of the planar member is the desired length of the extending portion of the tab.

A still further object of the present invention is to provide a one piece adhesive tab for forming a cantilevered extension along one edge of an expandable pocket-type folder wherein the tab does not adhere to the gusseted side walls of the folder, does not impair expansion and contraction of the folder, and does not increase the thickness of the folder, while still being able to extend along substantially the full length of the folder edge.

It is yet a further object of the present invention to provide a method of securing a one piece adhesive tab along one edge of a folder to form a cantilevered extension including the steps of placing one side of the tab adjacent one side of the folder wall, aligning a visual alignment device on the tab with the edge of the folder wall, affixing the one side of the tab to the one side of the folder wall, folding the tab along a line parallel to the folder edge, and affixing the other side of the tab to the opposite side of the folder wall.

Another object of the present invention is to provide a method of securing a one piece adhesive tab having a visual alignment edge along one edge of a folder to form a cantilevered extension including the steps of removing a tear-off portion to form the visual alignment edge and, if the tab is used on an expandable pocket-type folder, removing another tear-off portion to provide a cutout in which the gusseted folder side wall is received.

These and other objects are obtained by the one piece adhesive extension tab of the present invention. The extension tab forms a cantilevered extension along substantially the full length of one edge of a folder to permit labeling of the folder at a location beyond the borders of the folder. The extension tab includes an elongated rectangular planar member having first and second side or longitudinal edges and first and second end or lateral edges which define the two opposing rectangular planar surfaces of the planar member. A central fold line running lengthwise parallel to the side edges divides a first planar surface into two sides. The planar member is foldable in half along the fold line to form the tab which uses adhesive to secure the two sides of the folded planar member to the two sides of the folder.

A visual alignment mechanism formed on the tab facilitates straight and uniform positioning of the tab on the folder edge and aligns with the edge of the folder. The visual alignment mechanism includes an opening formed through the planar member through which the edge of the folder is viewable. A printed lengthwise line extends from the opening for alignment with the sighted folder edge. Additionally a third side edge parallel to the fold line extends a distance from one of the end edges so that the remaining lengthwise distance of the planar member is the length of the portion of the tab that extends from the folder after mounting. This third side edge also aligns with the folder edge and may be formed by removing a tear-off portion of the planar member.

When the folder is an expandable pocket type folder with gusseted or non-gusseted side walls, the planar member should include a fourth side edge parallel to the fold line. The distance between this edge and the fold line is the distance the tab extends from the folder back wall after mounting. This edge may be formed by removing another tear-off portion and extends from one end edge for a distance which corresponds to the height of the folder side walls. This fourth side edge prevents the tab from interfering with the operation and expansion of the folder side walls.

The present invention is also directed to a method of securing the adhesive extension tab along an edge of a folder or other item to form a cantilevered extension along the edge. The method includes the steps of placing one side of one surface of the planar member against a first side of the folder and aligning the visual alignment mechanism with the edge of the folder. The aligning step further includes aligning the sighting opening and the printed line with the edge of the folder and aligning the third side edge with the edge of the folder. A tear-off portion is first removed from an end edge of the planar member to form the third side edge. Next, the first side edge of the planar member is affixed to the first side of the folder, and the planar member is folded along the fold line. Then the other side of the elongate planar member is affixed to the second side of the folder. The folding step includes folding the planar member along the fold line to divide the planar member into the two sides.

Where the folder is an expandable pocket type folder, a second tear-off portion is removed from one end edge of the planar member to form the fourth side edge. Then this edge is disposed on the second side of the folder effectively collinear with the third side edge on the other side of the folder.

DETAILED DESCRIPTION OF PREFERRED EMBODIMENTS

Figure 1:
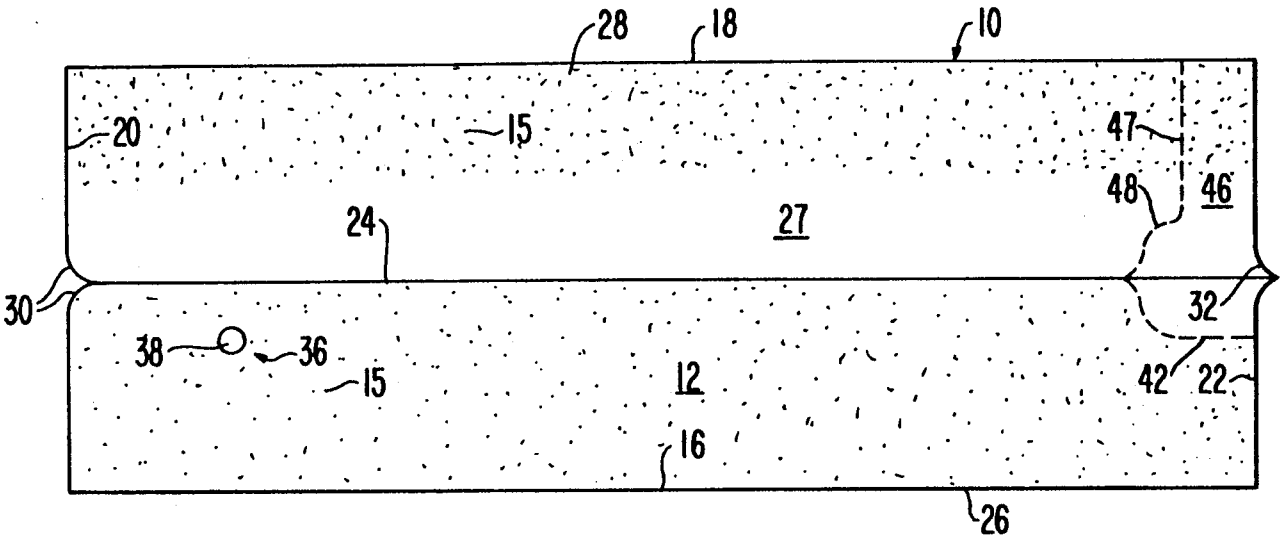
FIG. 1 is a front plan view of an extension tab according to one embodiment of the present invention.
Figure 2:
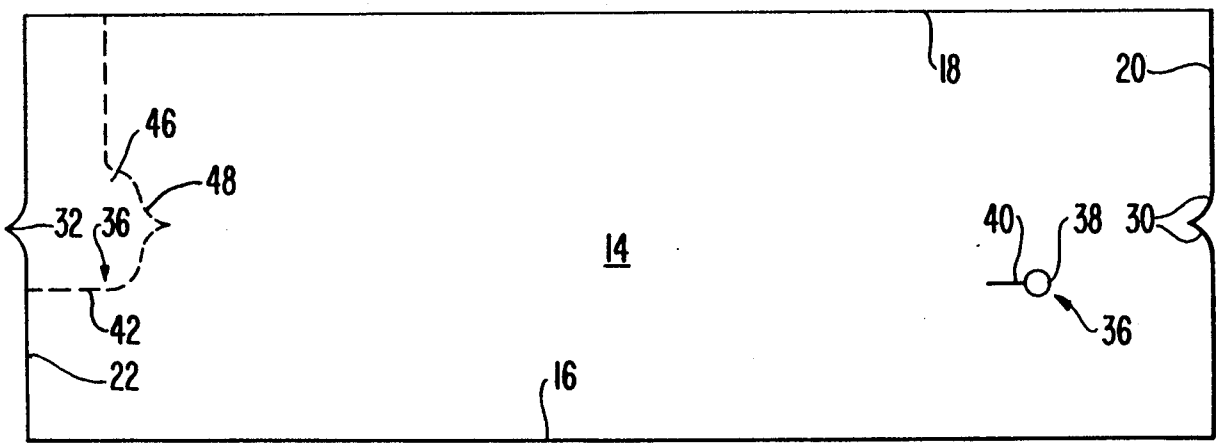
FIG. 2 is a rear plan view of the extension tab of FIG. 1.
Figure 3:
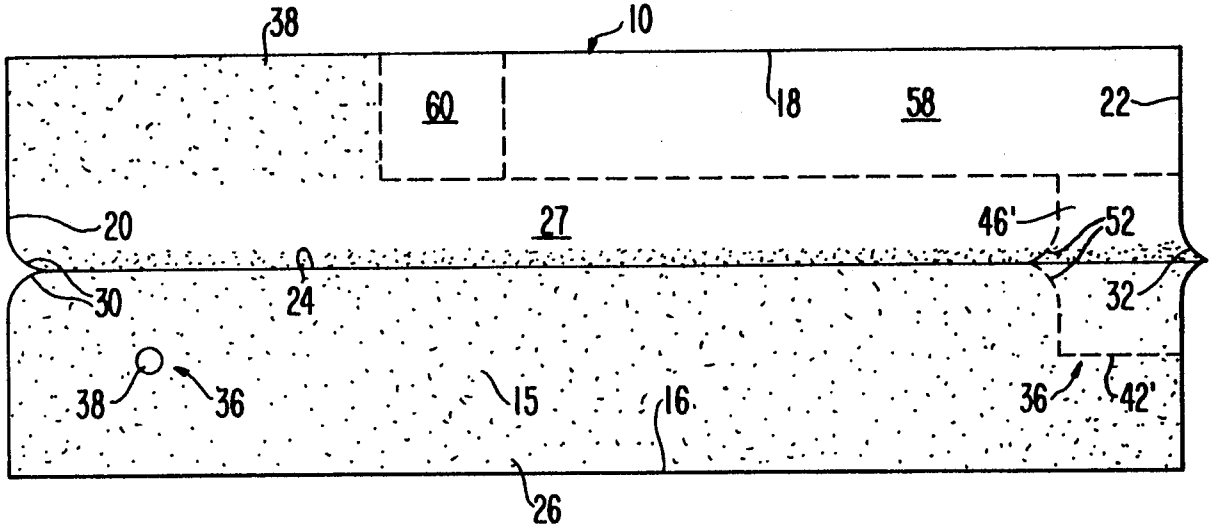
FIG. 3 is a front plan view of an extension according to another embodiment of the present invention.
Figure 4:
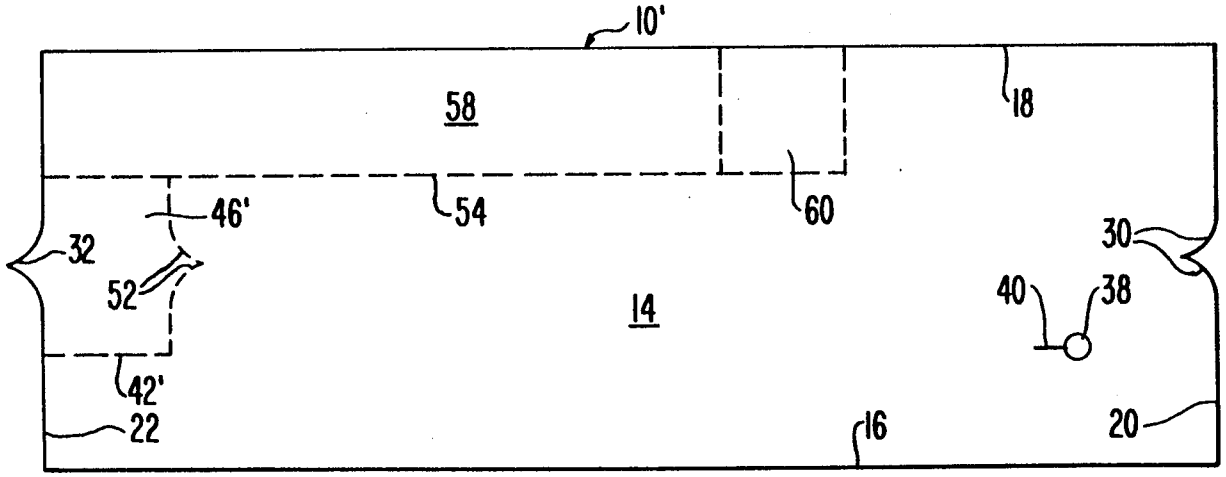
FIG. 4 is a rear plan view of the extension tab of FIG. 3.

FIGS. 1–4 illustrate two embodiments of the adhesive extension tab 10, 10' according to the present invention, which attach to an edge of a typical file folder to create an extension that is easily viewed from either side of the folder. The embodiment of FIGS. 1 and 2 is used primarily with open folder walls and the embodiment of FIGS. 3 and 4 is used primarily with expandable pocket type folder walls. Throughout this specification open folders refer to folders having front and rear walls hingedly connected together along one edge. The front and rear walls are not otherwise connected to each other and there are no side walls. Expandable pocket type folders refer to folders having two side walls connecting the front an rear walls. Although the side walls typically are gusseted, the extension tab is usable when the walls are not gusseted. Additionally, these expandable folders typically include a gusseted bottom wall although the existence of this, too, does not affect use of the extension tab.

The extension tab according to the present invention can be used on cards, folders, files, dividers, and other similar items with or without built-in tabs to form an extension tab. Although the extension tab will be described throughout this specification as being used on folders, the extension tab can be used with other stationery materials. Preferably the extension tab is disposed along substantially the entire side edge of the folder, although extension tabs that extend along less than the entire folder edge length are contemplated. When attached to a folder, the extension tab facilitates the physical retrieval of the folder from a shelf or other storage location. Additionally, the extension tab can receive labeling data such as alpha-numeric codes, color codes, or machine readable data, whether printed directly on the extension tab or affixed thereto as a label or other device.

Referring first to the embodiment of FIGS. 1 and 2, extension tab 10 is an elongated flat planar member having a first surface 12, shown in FIG. 1 and a second surface 14, shown in FIG. 2. As described in greater detail below, the first surface 12 becomes the inner surface when the tab is affixed to a folder, as by being disposed against the surface of the folder wall. An adhesive 15, represented by stippling, is disposed on this surface to secure the tab to the folder. The second surface becomes the outer surface and is disposed away from the folder wall surface to receive identifying information. The first and second surfaces 12, 14 of the extension tab 10 are substantially rectangular. Each of the first and second surfaces 12, 14 are bounded by opposing first and second longitudinal edges 16, 18 and opposing first and second lateral edges 20, 22.

In the preferred embodiments of the invention, the extension tabs 10 are attached or affixed to standard letter size ($9\frac{1}{2}'' \times 11\frac{1}{4}''$) or legal size ($9\frac{1}{2}'' \times 14\frac{3}{4}''$) open folders along the short ($9\frac{1}{2}''$) side edge of either the front or back folder wall. It is preferred that the tab be attached to the folder back wall. When used in these environments it is preferable that the extension tab 10 be at least $9\frac{1}{2}''$ long in the longitudinal direction, parallel to the longitudinal side edges 16, 18, and $3\frac{1}{2}''$ long in the lateral direction, perpendicular to the longitudinal direction and parallel to lateral side edges 20, 22.

Both longitudinal side edges are straight and a fold line, which preferably is a score line 24, extends parallel to the first and second longitudinal side edges 16, 18, from first lateral edge 20 to second lateral edge 22. The flat planar member that forms the extension tab 10 is foldable along score line 24 for attachment purposes. Preferably, score line 24 bisects first surface 12 into two sides of equal width, first longitudinal side 26 and second longitudinal side 28. The first longitudinal side 26 is located between the first longitudinal edge 16 and score line 24 and the second longitudinal side 28 is located between the second longitudinal edge 18 and score line 24.

Figure 6:
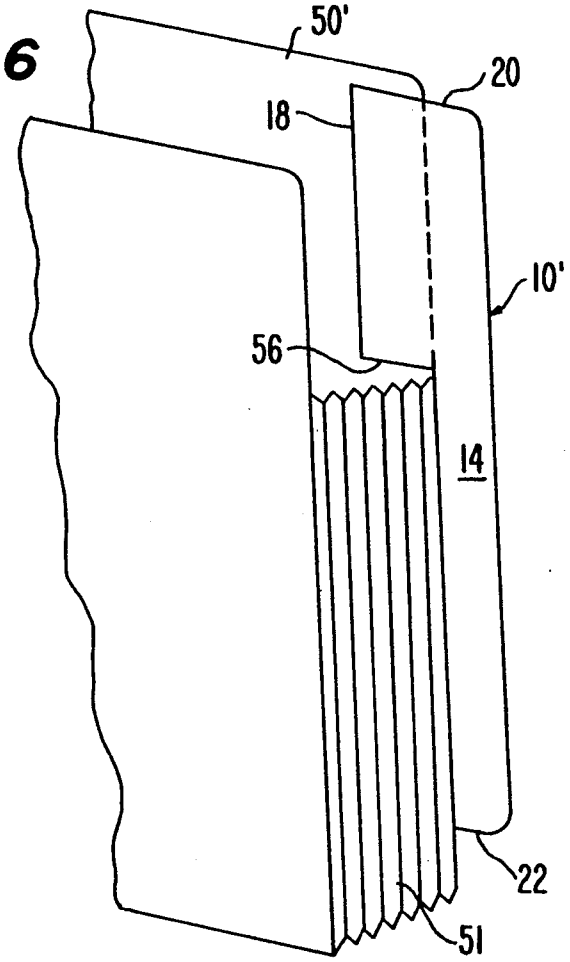
FIG. 6 is a perspective view of a portion of an expandable pocket-type folder on which the extension tab of FIGS. 3 and 4 has been attached.
Figure 5:
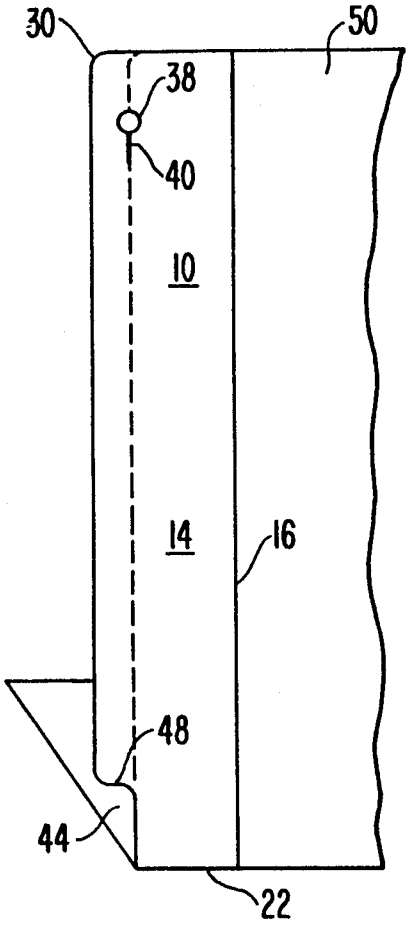
FIG. 5 is a perspective view of a portion of an open folder on which the extension tab of FIGS. 1 and 2 has been attached.

The lateral edges 20, 22 are straight except for their central portions bordering score line 24. On the first lateral edge 20, the edge curves inwardly toward score line 24 from both longitudinal edges to form two rounded corners 30, preferably having a $\frac{1}{4}''$ radius. The rounded corners form a curved upper corner of the extension tab upon application to a folder as shown in FIGS. 5 and 6 and discussed below. On the second lateral edge 22, a shape complementary to rounded corners 30 is formed extending outwardly from the tab. The formation of this extending portion 32 serves to simplify the machining required to manufacture the tab by eliminating cutting steps. This also reduces the cost of production. Although the extending portion 32 is not used to improve the function of the tab on a folder, it does not impede performance as it is disposed on a tear-off portion which is removed prior to attaching the tab on the folder as is described below.

The extension tab 10 is attached to a folder by adhesive, such as a pressure sensitive adhesive. Adhesive is disposed on the first surface 12 along the entire length of the tab disposed along both first longitudinal edge 16 and second longitudinal edge 18. While adhesive may completely cover the first longitudinal side 26 of first surface 12, at least a portion 27 of the second longitudinal side 28 of first surface 12, extending along score line 24, does not have adhesive for reasons that will be discussed below. During application of the tab on a folder wall the adhesive secures the first longitudinal side 26 of the first surface 12 to a first side of the back wall of the folder. Similarly, the adhesive secures the second longitudinal side 28 of the first surface to a second side of the back wall of the folder. The use of a pressure sensitive adhesive rather than a moisture activated adhesive avoids the problems commonly associated with moisture activated adhesive.

According to the present invention, the extension tab 10 includes a visual alignment mechanism 36 by which the tab may be properly aligned along the folder edge during application without trial and error. The visual alignment mechanism 36 actually includes two separate portions, either of which alone may be sufficient; although, in the illustrated preferred embodiments, both are used.

The first portion of the visual alignment mechanism 36 includes a window or opening 38 formed through the first longitudinal side 26 of the tab between the first and second surfaces 12, 14. Preferably, the center of opening 38 is located at a predetermined perpendicular distance from the fold line 24 that is equal to the distance tab 10 is desired to extend beyond the edge of the folder. When used with open folders, this distance preferably is approximately ½". The center of opening 38 is also preferably located 1"–2" from the first lateral edge 20, although no specific distance is believed to be superior. At least one longitudinally disposed line 40 is printed or otherwise placed on the first longitudinal side 26 on the second surface 14, although two lines 40, one on each side of opening 38, may be used. The line 40 extends from the opening 38 in a direction parallel to score line 24 and first longitudinal edge 16.

To align the extension tab 10 with the edge of the folder wall, the first longitudinal side 26 of first surface 12 is located facing the first surface of the folder rear wall. The edge of the folder rear wall is sighted through the opening 38 and is aligned with line 40 prior to affixing side 26 to the folder wall. This insures proper alignment of the tab 10 so that it runs parallel to the folder rear wall.

The second portion of the visual alignment mechanism includes a third longitudinal edge 42 which is parallel to and between score line 24 and first longitudinal edge 16 on the first longitudinal side 26 and is collinear with line 40. The third longitudinal edge 42 forms one side boundary of a cutout 44 (FIG. 5) formed by removing tear-off portion 46, and is aligned with the edge of the folder wall during application of the tab. The third longitudinal edge 42 extends for a predetermined distance from the second lateral edge 22 which, when subtracted from the total longitudinal length of the planar member which forms the tab, yields the desired longitudinal length of the portion of the extension tab which extends from the folder wall. As shown, the tear-off portion 46 extends from the third longitudinal edge 42, across score line 24, to the second longitudinal edge 18.

Additionally, the tear-off portion 46 is connected to the remainder of tab 10 by any manner of known frangible connection, such as a cut-score, perforation, etc. This frangible connection is in the form of a continuous line 47 that begins with a straight line portion running perpendicularly from longitudinal edge 18 and connects with a bracket-shaped portion which, in turn, merges into a straight line portion that creates third edge 42. Bracket-shaped portion 48 forms a curved upper corner of the extension tab upon application to a folder that is matched to rounded portions 30 at the opposite corner. Thus, both upper corners of the extension tab 10, as attached to a folder, are rounded.

Referring to FIG. 5, it will now be seen how mounting or applying of the extension tab 10 to a folder back wall 50 is very simple and requires few steps. To begin, tear-off portion 46 is removed to form cutout portion 44 having third longitudinal edge 42. Then, the first longitudinal side 26 of the first surface 12 is placed in proximity to a first side of folder back wall 50. Next, the edge of folder back wall 50 is sighted through opening 38, aligned with line 40, and aligned with the third longitudinal edge 42. Once properly aligned, the first longitudinal side 26 is adhered to the first side of the folder back wall 50 and the extension tab is folded along score line 24. Finally, the second longitudinal side 28 is adhered to the second side of the folder back wall 50 and a portion of the first longitudinal side extending along score line 24.

Because, as shown in FIG. 1, the second longitudinal side 28 has at least the portion adjacent score line 24 in the longitudinal vicinity of opening 38 free of adhesive, when extension tab 10 is mounted on folder back wall 50, opening 38 on the first longitudinal side 26 lies opposite the portion of the second longitudinal side without adhesive. This prevents dirt and other particles from sticking to the tab by contacting the portion of side 28 that is exposed through opening 38. As illustrated, for ease of manufacture, the nonadhesive portion of the second longitudinal side extends for the entire longitudinal distance of the extension tab.

A further convenience of this extension tab is that directions for applying the tab can be printed directly on the tab so that they can never be misplaced apart from the tab. However, the directions preferably are printed on the tear-off portion so that they are disposable and not part of the finished extension tab, thereby improving its appearance.

Turning now to the extension tab embodiment for use with expandable pocket type folders, this tab, shown in its initial form in FIGS. 3 and 4 and attached to a pocket type folder having gusseted side walls 51 (only one of which is shown) in FIG. 6, has substantially the same features as the open folder tab embodiment. Although FIG. 5 illustrates the extension tab of FIGS. 1 and 2 mounted on an open folder, a similar view of the extension tab 10' of FIGS. 3 and 4 mounted on an open or pocket folder would have the same appearance, and therefore, is not separately shown. Identical features and components of this embodiment are referenced with the same numerals and are not redescribed. Modified features also share the same reference numerals but, in this case, distinguish by a prime (') symbol, and additional features having no counterpart in tab 10, are designated by new reference numerals.

The extension tab 10' for pocket type folders is larger to accommodate the larger features of standard letter size (10"×12") or legal size (10"×15") expandable pocket folders. As this embodiment of the extension tab 10' is slightly larger than the open folder embodiment, the proportions and absolute locations of opening 38 and tear-off portion 46' may vary. For example, the perpendicular distance from the score line 24 to the center of opening 38 is preferably ¾". However, these components are still configured and oriented to achieve the same results. The only other difference regarding the previously discussed elements is that where, in the open folder tab of FIGS. 1–2, the tear-off portion 46 includes a bracket-shaped portion 48 of a frangible connection line 47, in the embodiment of FIGS. 3 and 4, this edge is formed with two rounded portions 52, similar to rounded portions 30. These rounded portions 52, like rounded portions 30, form a curved upper corner of the extension tab upon attaching the tab to a folder.

Like the open folder embodiment, this tab 10' is disposed along the short (10'') side edge of either the front or back folder wall, although it is preferable to attach the tab to the folder back wall. To accommodate the side walls of the folder, which typically are gusseted, and to prevent the tab from interfering with the operation and expansion of the folder side walls, the extension tab 10' includes a fourth longitudinal edge 54 which is parallel to and between score line 24 and second longitudinal edge 18 on the second longitudinal side 28. The fourth longitudinal edge 54 forms one side boundary of a cutout 56 (FIG. 6) formed by removing tear-off portion 58 and extends from the second lateral edge 22. The distance between the score line 24 and the fourth longitudinal edge 54 corresponds to the distance the extension tab 10' extends from the folder back wall when the tab is folded along the score line and mounted on the folder.

The tear-off portion 58 and therefore the fourth longitudinal edge 54 extend from the second lateral edge 22 a distance corresponding to the height of the folder side walls 51 or somewhat less if it is not necessary for tab 10' to extend completely to the bottom edge back wall 50'. As shown, tear-off portion 58 is 5½" long to accommodate 5½" high side walls. However, a secondary 1" long tear-off portion 60 is disposed adjacent to tear-off portion 58 to accommodate 6½" folder side walls. Thus, with the tear-off portion 58 (and 60 where necessary) removed, extension tab 10' can be attached to the side edge of a pocket type folder back wall 50' along substantially the entire height of the back wall without having to be attached to any portion of the gusseted folder side wall 51. This enables the side wall 51 to expand and contract freely, as needed, and does not increase the thickness of the folder.

The steps of the method for attaching this extension tab 10' on a pocket folder back wall 50' are the same as for an open folder. However, this method also includes the additional steps of removing the tear-off portion 58 and also, when necessary, the tear-off portion 60 to form cutout 56 having fourth longitudinal edge 54. When the tab is folded, the fourth longitudinal edge 54 is oriented so that it is effectively collinear with the third longitudinal edge 42'. This verifies and insures that the fourth longitudinal edge lies along the edge of the folder back wall 50' to avoid interference with the folder side walls 51. Like the open folder tab 10, the directions for applying the tab are printed directly on the tab itself and preferably on the tear-off portions.

The extension tabs described above are formed preferably of a stock material, such as 40 pound kraft paperboard, which is preferably as durable as the folders on which the tabs are employed. As described, the pocket folder tab 10' is usable on an open folder without modification; although, a single embodiment encompassing the features of both tabs 10 and 10' may be used with greater versatility on either type of folder or on other stationery materials as long as the tab is of the desired size and shape. Along these lines, tabs having differing dimensions may be used in different environments and for different needs. Various other modifications and variations will also now be apparent to those skilled in the art so that the present invention should not be viewed as limited to the embodiments described herein.

We claim:

1. A one piece adhesive tab for forming a cantilevered extension along an edge of a planar sheet to permit labeling of the planar sheet at a location beyond the borders of said planar sheet, said adhesive tab comprising:

an elongated planar member having planar, opposed first and second surfaces which extend between first and second longitudinal edges and first and second lateral edges of said member; a fold line which runs along a longitudinal axis of the planar member parallel to said first and second longitudinal edges for substantially the entire length of said elongated planar member, said fold line dividing said elongated planar member into a first longitudinal side, and a second longitudinal side; and wherein said elongated planar member is foldable along said fold line to form said adhesive tab;

visual alignment means disposed on said elongated planar member for facilitating straight and uniform positioning of said adhesive tab on the edge of the planar sheet, said visual alignment means for alignment with the edge of the planar sheet and including an opening formed through said first longitudinal side of said elongated planar member between said first and second surfaces and through which, in use, a portion of the edge of the planar sheet is viewable, and at least one longitudinal line disposed on said second surface extending from said opening parallel to said fold line for aligning with the portion of the edge of the planar sheet; and adhesive means for securing at least a portion of said first surface of said first longitudinal side of the elongated planar member to a first side of the planar sheet and for securing at least a portion of said first surface on said second longitudinal side of said elongated planar member to a second side of the planar sheet.

2. The adhesive tab according to claim 1, wherein the perpendicular distance between said longitudinal line and said fold line is set at the distance said adhesive tab is to extend from the edge of the planar sheet when said adhesive tab is mounted on the planar sheet.

3. The adhesive tab according to claim 1, wherein said visual alignment means comprises a third longitudinal edge of the elongated member that is parallel to said fold line and formed on said first longitudinal side of said elongated planar member at a predetermined perpendicular distance from said fold line, for aligning with the edge of the planar sheet.

4. The adhesive tab according to claim 3, wherein said third longitudinal edge has a length that extends a predetermined distance from said second lateral edge; and wherein the difference between the length of said third longitudinal edge distance and the total length of said elongated planar member is the desired longitudinal length of the extending portion of said adhesive tab.

5. The adhesive tab according to claim 3, wherein the perpendicular distance between said third longitudinal edge and said fold line is the distance said adhesive tab extends from the edge of the planar sheet when said adhesive tab is mounted on the planar sheet.

6. The adhesive tab according to claim 3, wherein said elongated planar member is provided with a tear-off portion which serves as a means for forming said third longitudinal edge by removing the first tear-off portion of said elongated planar member, said first tear-off portion being disposed at said second lateral edge and extending from said third longitudinal edge across said fold line to said second longitudinal edge for the length of said third longitudinal edge.

7. The adhesive tab according to claim 3, wherein said visual alignment means further comprises an opening formed through said first longitudinal side of said elongated planar member between said first and second surfaces and through which, in use, a portion of the edge of the planar sheet is viewable, and a longitudinal line disposed on said second surface extending from said opening parallel to said fold line for aligning with the portion of the edge of the planar sheet; wherein the perpendicular distance between said longitudinal line and said fold line is set at the distance said adhesive tab is to extend from the edge of the planar sheet when said adhesive tab is mounted on the planar sheet.

8. The adhesive tab according to claim 7, wherein said opening and said longitudinal line are disposed closer to said first lateral edge than to said second lateral edge.

9. The adhesive tab according to claim 1 wherein said adhesive means is disposed on said first surface at both of said first and second longitudinal sides of said elongated planar member; and wherein said adhesive means is disposed on said second longitudinal side such that the portion of said second longitudinal side disposed opposite and visible through said opening is free of adhesive means when said elongated planar member is folded along said fold line.

10. The adhesive tab according to claim 1, wherein the planar sheet is a wall of a folder having a front wall and a back wall joined at a respective edge of each said front wall and back wall; and said adhesive tab is substantially as long as an edge of one of said folder walls.

11. The adhesive tab according to claim 10 wherein said folder includes side walls interconnecting said front and back walls to form a pocket; wherein said elongated planar member comprises a fourth longitudinal edge extending parallel to said fold line and formed on said second longitudinal side; and where the perpendicular distance between said fourth longitudinal edge and said fold line is set at the distance said adhesive tab is to extend from the edge of said one of the folder walls when said adhesive tab is mounted on the folder.

12. The adhesive tab according to claim 11, wherein said fourth longitudinal edge is formed of a second tear-off portion that is disposed on said second longitudinal side and extends from said second lateral edge for a longitudinal distance corresponding to approximately the height of the folder side walls.

13. The adhesive tab according to claim 11, wherein said visual alignment means comprises a third longitudinal edge that is parallel to said fold line and formed on said first longitudinal side of side elongated planar member; wherein said third longitudinal edge has a length that extends for a predetermined perpendicular distance from said second lateral edge and a predetermined perpendicular distance from said fold line for aligning with said edge of said wall of the folder; wherein the difference between the length of the third longitudinal edge and the total length of said elongated planar member is the desired length of the extending portion of said adhesive tab; and wherein said third longitudinal edge corresponds to said fourth longitudinal edge when said elongated planar member is folded along said fold line.

14. The adhesive tab according to claim 1, wherein said fold line is scored.

* * * * *